US007452045B2

(12) United States Patent
Suzuki

(10) Patent No.: US 7,452,045 B2
(45) Date of Patent: Nov. 18, 2008

(54) INK-JET RECORDING APPARATUS

(75) Inventor: Katsuaki Suzuki, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/829,971

(22) Filed: Jul. 30, 2007

(65) Prior Publication Data

US 2008/0030533 A1 Feb. 7, 2008

(30) Foreign Application Priority Data

Aug. 3, 2006 (JP) ..... 2006-211754
Aug. 7, 2006 (JP) ..... 2006-214891

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS 6,471,352 B2 * 10/2002 Akahira ..... 347/106
6,698,862 B1 * 3/2004 Choi et al. ..... 347/17

FOREIGN PATENT DOCUMENTS

JP 2002036568 A 2/2002
JP 2003-127370 A 5/2003
JP 2003-182056 A 7/2003
JP 2006-035568 A 2/2006

OTHER PUBLICATIONS

Japanese Patent Office, Notice of Reasons for Rejection for corresponding Japanese Patent Application No. 2006-214891, mailed Sep. 2, 2008.

Japanese Patent Office, Notice of Reasons for Rejection for corresponding Japanese Patent Application No. 2006-211754, mailed Jul. 29, 2008.

* cited by examiner

*Primary Examiner*—Thinh H Nguyen
(74) *Attorney, Agent, or Firm*—Baker Botts L.L.P.

(57) ABSTRACT

A waveform signal output circuit selectively outputs, to an ejection energy applier, either one of a first waveform signal so as to make an ink droplet ejected from a nozzle and a second waveform signal so as not to make an ink droplet ejected from the nozzle. A continuous non-ejection counter counts a continuous non-ejection number. A ejection history memory stores therein an ejection history. A non-ejection frequency detector detects a non-ejection frequency. A thickening degree determiner determines a thickening degree of ink in the nozzle. A waveform signal selector makes the waveform signal output circuit output the second waveform signal to the ejection energy applier when an ink droplet is not ejected in the current printing cycle and in addition a thickening degree is equal to or greater than a predetermined value.

10 Claims, 14 Drawing Sheets

INK-JET RECORDING APPARATUS

CROSS REFERENCE TO RELATED APPLICATION

The present application claims priority from Japanese Patent Applications No. 2006-211754, which was filed on Aug. 3, 2006, and No. 2006-214891, which was filed on Aug. 7, 2006, the disclosures of which are herein incorporated by reference in its entirety.

BACKGROUND OF THE INVENTION

1. Field of the Invention

The present invention relates to an ink-jet recording apparatus which performs a printing by ejecting ink droplets.

2. Description of Related Art

An ink-jet head included in an ink-jet recording apparatus which ejects ink droplets to a recording medium such as a recording paper is sometimes provided with a passage unit and an actuator. The passage unit has nozzles which eject ink droplets and pressure chambers which communicate with the nozzles. The actuator applies ejection energy to ink contained in the pressure chambers. The actuator applies pressure to a pressure chamber by changing a volume of the pressure chamber. Known as the actuator is one including a piezoelectric sheet which extends over a plurality of pressure chambers, a plurality of individual electrodes which are opposed to the respective pressure chambers, and a common electrode which is opposed to the plurality of individual electrodes with the piezoelectric sheet sandwiched therebetween and to which a reference potential is applied (see Japanese Unexamined Patent Publication No. 2002-36568 for example). In this actuator, a pulsed drive potential is applied to an individual electrode so that an electric field in a thickness direction of a piezoelectric layer acts on a portion of the piezoelectric sheet sandwiched between this individual electrode and the common electrode. As a result, in this portion, the piezoelectric sheet expands in the thickness direction. This changes a volume of a corresponding pressure chamber, and accordingly pressure as ejection energy is applied to ink contained in the pressure chamber.

SUMMARY OF THE INVENTION

A higher-speed printing is now demanded of an ink-jet printer. In order to obtain a higher printing speed, it is necessary to shorten a printing cycle, which is a cycle of ejecting an ink droplet. Shortening the printing cycle involves using ink of quick-drying type which enables an ink droplet having landed on a recording paper to dry up instantly. However, when such ink of quick-drying type is used, ink contained in a nozzle may be thickened due to drying, which may deteriorate ink ejection performance or cause ejection failures. A possible way to avoid such a problem is to perform a flushing ejection in a region outside a print region, to eject an ink droplet from a nozzle. With ink of quick-drying type, however, even though the flushing ejection is performed, ink contained in a nozzle which is less often used in a printing operation is thickened. As a result, an ejection of an ink droplet from the nozzle may be delayed, to deteriorate quality of an image recorded on a recording medium.

An object of the present invention is to provide an ink-jet printing apparatus which is able to restrain ink thickening in a printing operation.

Another object of the present invention is to provide an ink-jet recording apparatus which is able to restrain a delay in ejection of an ink droplet to thereby form a high-quality image on a recording medium.

According to a first aspect of the present invention, there is provided an ink-jet recording apparatus including an ink-jet head, a conveyance mechanism, a waveform signal output circuit, a continuous non-ejection counter, an ejection history memory, a non-ejection frequency detector, a thickening degree determiner, and a waveform signal selector. The ink-jet head has a passage unit in which formed are a plurality of individual ink passages each extending from an exit of a common ink chamber through a pressure chamber to a nozzle, and an ejection energy applier which applies ink ejection energy to ink contained in the pressure chamber. The conveyance mechanism moves a recording medium relative to the ink-jet head. The waveform signal output circuit selectively outputs, to the ejection energy applier, either one of a first waveform signal including a pulse for driving the ejection energy applier so as to make an ink droplet ejected from the nozzle and a second waveform signal including a pulse for driving the ejection energy applier so as not to make an ink droplet ejected from the nozzle. The continuous non-ejection counter counts, for each nozzle, a continuous non-ejection number which means the number of printing cycles during which non-ejection of an ink droplet from the nozzle continues until a latest printing cycle, where a printing cycle is a time required for a relative movement of the recording medium by a unit distance which corresponds to a printing resolution of an image to be formed. The ejection history memory stores therein, for each nozzle, an ejection history of whether an ink droplet has been ejected from the nozzle or not in each of a predetermined number of continuous printing cycles up to the latest printing cycle. The non-ejection frequency detector detects, for each nozzle, a non-ejection frequency which corresponds to an occurrence pattern of, in the ejection history stored in the ejection history memory, the printing cycle during which an ink droplet has not been ejected from the nozzle. The thickening degree determiner determines, for each nozzle, a thickening degree of ink in the nozzle based on the continuous non-ejection number counted by the continuous non-ejection counter and the non-ejection frequency detected by the non-ejection frequency detector. The waveform signal selector makes the waveform signal output circuit output the second waveform signal to the ejection energy applier corresponding to a nozzle, when an ink droplet is not ejected from the nozzle in the current printing cycle and in addition a thickening degree in the nozzle determined by the thickening degree determiner is equal to or greater than a predetermined value.

According to the first aspect, the non-ejection frequency detector detects a non-ejection frequency for each nozzle based on the ejection history, and the thickening degree determiner determines a thickening degree of ink in each nozzle based on a continuous non-ejection number and a non-ejection frequency for the nozzle. As a consequence, a thickening degree of ink in each nozzle can be accurately obtained. When a thickening degree of ink in a nozzle becomes equal to or greater than a predetermined value, the waveform signal selector makes the waveform signal output circuit output the second waveform signal so that a non-ejection flushing is performed in the nozzle and ink in the nozzle is stirred to thereby reduce the thickening degree of the ink. As a result, a delay in ejection of an ink droplet from the nozzle hardly occurs, to allow a high-quality image to be formed on a recording medium.

According to a second aspect of the present invention, there is provided an ink-jet recording apparatus including an ink-jet head, a conveyance mechanism, a waveform signal output circuit, a continuous non-ejection counter, an ejection history memory, a non-ejection frequency detector, a thickening degree determiner, and a potential controller. The ink-jet head has a passage unit in which formed are a plurality of individual ink passages each extending from an exit of a common ink chamber through a pressure chamber to a nozzle, and an ejection energy applier which applies ink ejection energy to ink contained in the pressure chamber. The conveyance mechanism moves a recording medium relative to the ink-jet head. The waveform signal output circuit outputs, to the ejection energy applier, a waveform signal including a pulse for driving the ejection energy applier so as to make an ink droplet ejected from the nozzle. The continuous non-ejection counter counts, for each nozzle, a continuous non-ejection number which means the number of printing cycles during which non-ejection of an ink droplet from the nozzle continues until a latest printing cycle, where a printing cycle is a time required for a relative movement of the recording medium by a unit distance which corresponds to a printing resolution of an image to be formed. The ejection history memory stores therein, for each nozzle, an ejection history of whether an ink droplet has been ejected from the nozzle or not in each of a predetermined number of continuous printing cycles up to the latest printing cycle. The non-ejection frequency detector detects, for each nozzle, a non-ejection frequency which corresponds to an occurrence pattern of, in the ejection history stored in the ejection history memory, the printing cycle during which an ink droplet has not been ejected from the nozzle. The thickening degree determiner determines, for each nozzle, a thickening degree of ink in the nozzle based on the continuous non-ejection number counted by the continuous non-ejection counter and the non-ejection frequency detected by the non-ejection frequency detector. When ejecting an ink droplet from a nozzle in a current printing cycle, the potential controller controls the waveform signal output circuit in such a manner that a drive potential of the ejection waveform signal for making an ink droplet ejected from the nozzle becomes higher as a thickening degree in the nozzle determined by the thickening degree-determiner increases.

According to the second aspect, the non-ejection frequency detector detects a non-ejection frequency for each nozzle based on the ejection history, and the thickening degree determiner determines a thickening degree of ink in each nozzle based on a continuous non-ejection number and a non-ejection frequency for the nozzle. As a consequence, a thickening degree of ink in each nozzle can be accurately obtained. When ejecting an ink droplet from a nozzle, the potential controller controls the waveform signal output circuit in such a manner that a drive potential of the ejection waveform signal for making an ink droplet ejected from the nozzle becomes higher as a thickening degree in the nozzle increases. Thus, as a thickening degree of ink in the nozzle is greater, higher ink ejection energy is applied to a corresponding pressure chamber. As a result, a delay in ejection of an ink droplet from the nozzle can be restrained, to allow a high-quality image to be formed on a recording medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a first preferred embodiment of the present invention will be described.

Figure 1:
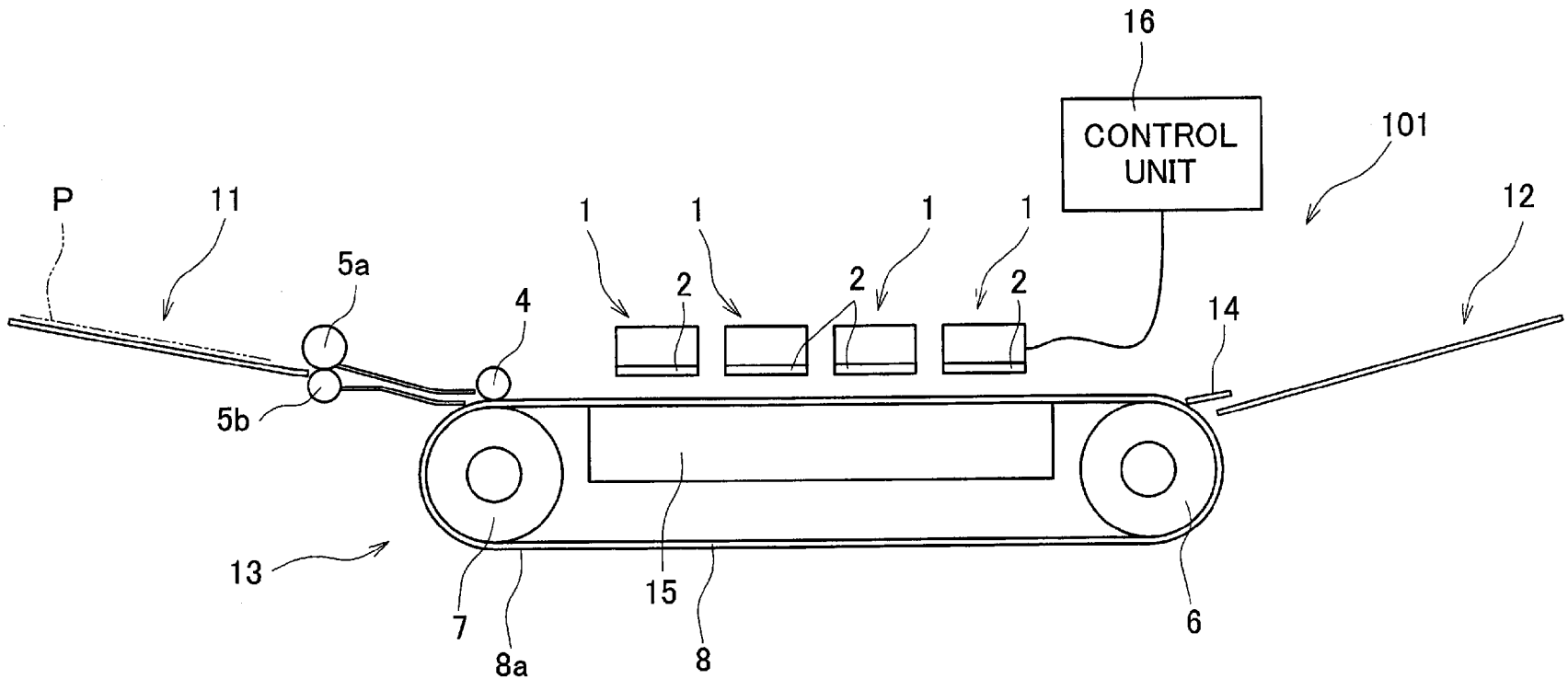
FIG. 1 illustrates a general construction of a printer according to a first embodiment of the present invention.

FIG. 1 illustrates a general construction of a printer, which is an ink-jet recording apparatus, according to a first embodiment of the present invention. As shown in FIG. 1, a printer 101 is a line-type ink-jet printer having four ink-jet heads 1 arranged side by side in a horizontal direction in FIG. 1. The ink-jet printer 101 includes a paper feed unit 11, a paper discharge unit 12, and a paper conveyor 13, which are shown in left, right, and middle parts of FIG. 1, respectively. In the printer 101, the control unit 16 controls operations of the ink-jet heads 1.

Recording papers P, which are recording media for a printing to be performed thereon, are disposed in the paper feed unit 11. In performing a printing, the recording papers P are one by one conveyed rightward in FIG. 1 by a pair of paper feed rollers 5*a* and 5*b*. The paper conveyor 13 has two feed rollers 6 and 7, and also has an endless conveyor belt 8 wound on the feed rollers 6 and 7. As the feed rollers 6 and 7 rotate, the conveyor belt 8 accordingly rotates. A nip roller 4 is disposed above the feed roller 7, and the conveyor belt 8 is sandwiched between the nip roller 4 and the feed roller 7. A surface of the conveyor belt 8 facing away from the feed rollers 6 and 7, that is, an outer surface of the conveyor belt 8 serves as a conveyor face 8*a* for conveying a recording paper P. The conveyor face 8*a* is treated with adhesive silicone rubber. A recording paper P conveyed by the paper feed rollers 5*a* and 5*b* is pressed to the conveyor face 8*a* by the nip roller 4 and the feed roller 7, and in this state conveyed onto the conveyor face 8*a* and adheres to the conveyor face 8*a*.

The recording paper P thus conveyed onto the conveyor face 8*a* is conveyed rightward in FIG. 1 by the conveyor belt 8. That is, the conveyor belt 8 moves the recording paper P relative to the ink-jet heads 1. At this time, the conveyor belt 8 conveys the recording paper P at a constant speed so as to make the recording paper P move rightward in FIG. 1 by a unit distance corresponding to a printing resolution within a predetermined period of time which is equal to a printing cycle.

When the recording paper P comes to a position opposed to the ink-jet heads 1, ink droplets are ejected from later-described nozzles 108 (see FIG. 3) of head main bodies 2 which are provided on lower faces of the ink-jet heads 1. Thereby, a printing is performed. Here, for example, ink-jet heads 1 eject, sequentially from the one shown left in FIG. 1, black ink droplets, magenta ink droplets, cyan ink droplets, and yellow ink droplets, respectively. A portion of the conveyor belt 8 opposed to the ink-jet heads 1 is provided with a platen 15 which supports the conveyor belt 8 from a side opposite to the conveyor face 8*a*. Accordingly, a portion of the conveyor face 8*a* opposed to the ink-jet heads 1 is kept horizontal. As shown in FIG. 1, the platen 15 is disposed inside the conveyor belt 8, and in contact with an inner surface of the conveyor belt 8. A predetermined space is formed between the platen 15 and the lower faces of the ink-jet heads 1. Thus, the ink-jet heads 1 eject ink droplets in a state where a recording paper P is horizontally placed. At this time, the recording paper P and the lower faces of the ink-jet heads 1 are spaced from each other by a predetermined distance.

Referring to FIG. 1, a peeling plate 14 is provided on a right side of the paper conveyor 13. A left end of the peeling plate 14 enters between a recording paper P and the conveyor belt 8, thereby peeling the recording paper P from the conveyor belt 8. The recording paper P thus peeled off by the peeling plate 14 is placed into the discharge unit 12.

Figure 2:
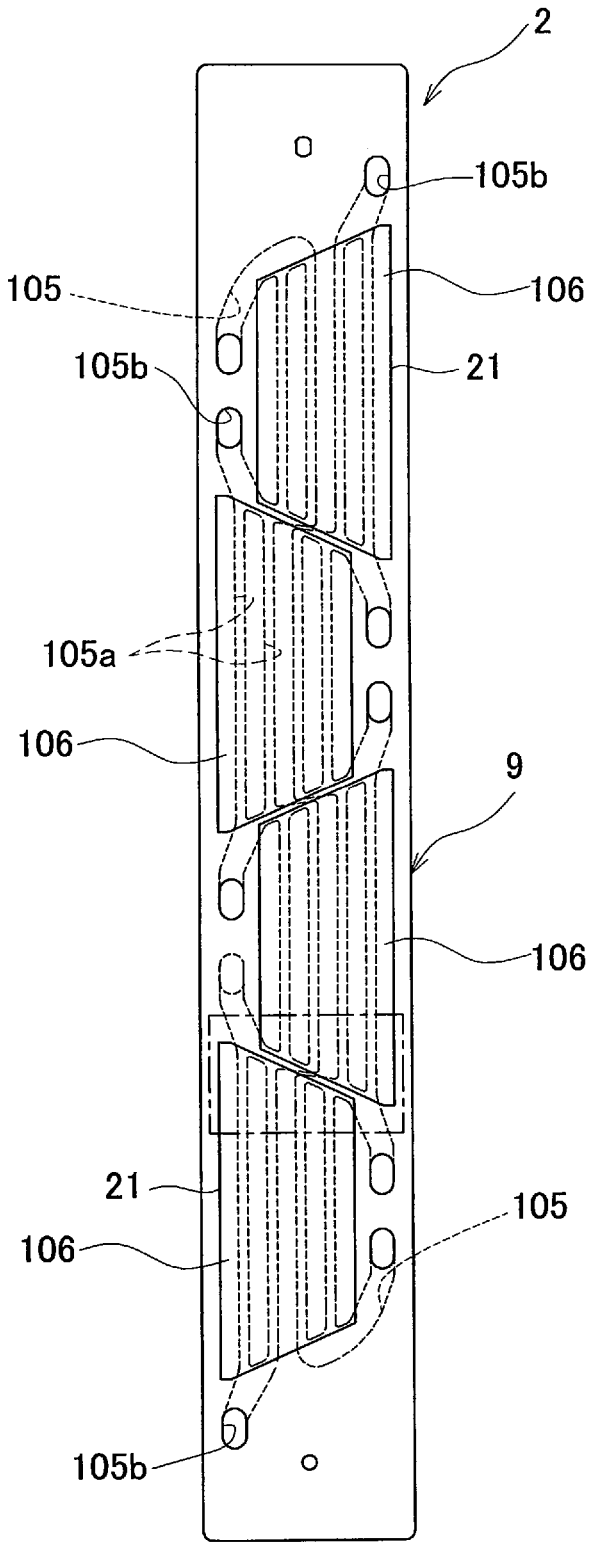
FIG. 2 is a plan view of a head main body shown in FIG. 1.
Figure 3:
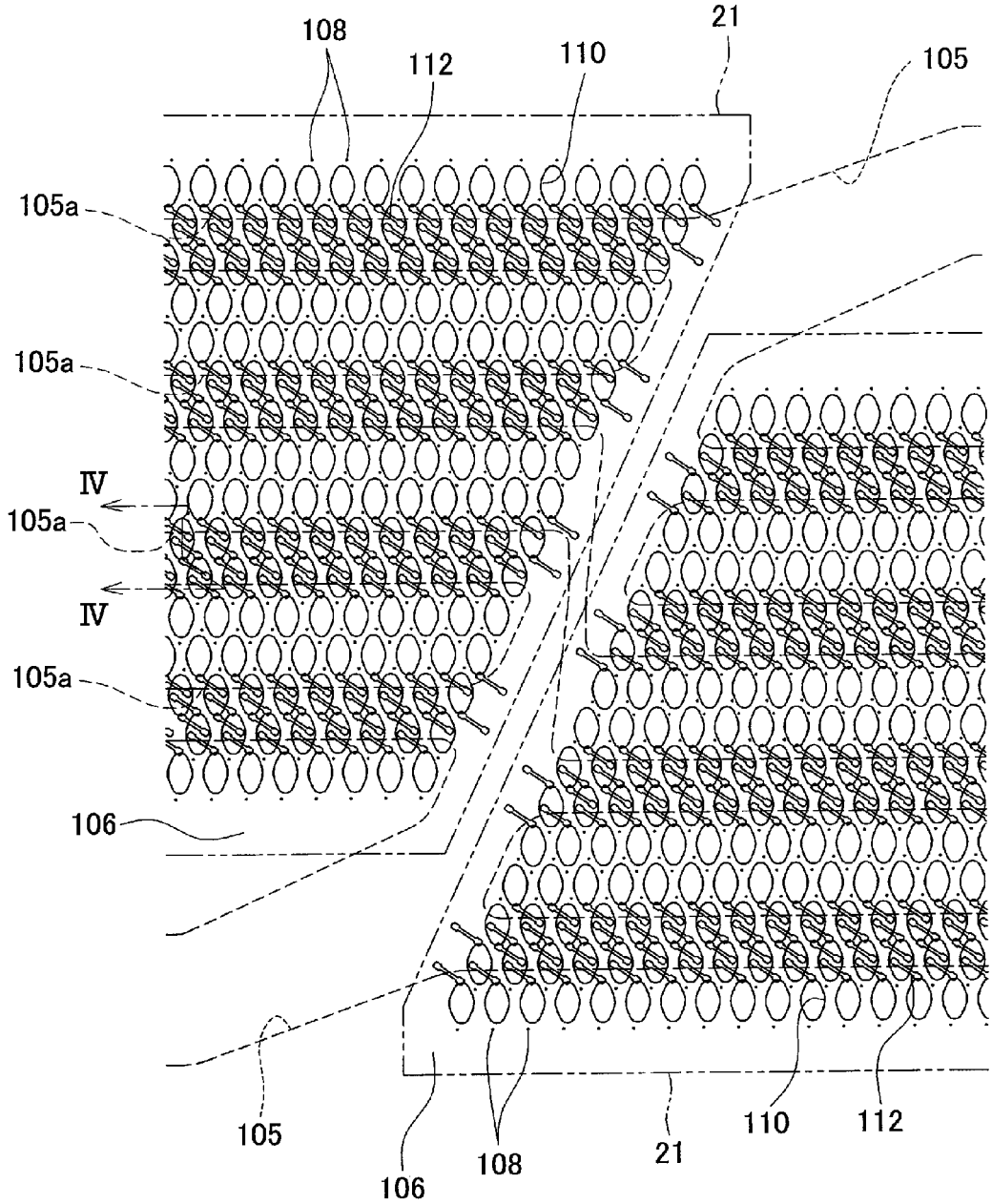
FIG. 3 is an enlarged view of a region enclosed by an alternate long and short dash line in FIG. 2.

Next, a head main body 2 which ejects ink droplets to a recording paper P will be described with reference to FIGS. 2 and 3. FIG. 2 is a plan view of the head main body 2. FIG. 3 is an enlarged view of a region enclosed by an alternate long and short dash line in FIG. 2.

The head main body 2 has a passage unit 9. In the passage unit 9, a plurality of pressure chambers 110 and a plurality of nozzles 108 which communicate with the respective pressure chambers 110 are formed. Four piezoelectric actuators 21 of trapezoidal shape are bonded to an upper face of the passage unit 9. The four piezoelectric actuators 21 are arranged in two rows in a zigzag pattern. More specifically, each of the piezoelectric actuators 21 is disposed with its parallel opposed sides, which mean upper and lower sides, extending along a longitudinal direction of the passage unit 9. In addition, oblique sides of every neighboring piezoelectric actuators 21 overlap each other with respect to the longitudinal direction of the passage unit 9.

Portions of the passage unit 9 overlapping the respective piezoelectric actuators 21 in a plan view serve as ink ejection regions 106. As shown in FIG. 3, a plurality of nozzles 108 are regularly arranged on surfaces of the ink ejection regions 106, and correspondingly a plurality of pressure chambers 110 are arranged in a matrix on the upper face of the passage unit 9.

In the ink ejection regions 106, nozzles 108 are arranged in a matrix similarly to the pressure chambers 110. In this embodiment, as shown in FIG. 3, a plurality of nozzles 108 form sixteen nozzle rows. The number of nozzles 108 included in each nozzle row gradually decreases from the lower side to the upper side of the trapezoidal shape. With respect to the longitudinal direction of the passage unit 9, each of the nozzle rows existing in one ink ejection region 106 overlaps a corresponding nozzle row existing in, among the zigzag-arranged ink ejection regions 106, an ink ejection region whose parallel opposed sides overlaps parallel opposed sides of the one ink ejection region 106 with respect to the longitudinal direction.

Manifold channels 105 and sub manifold channels 105*a* are formed inside the passage unit 9. The manifold channels 105 act as a common ink chamber, and the sub manifold channels 105*a* are branch passages of the manifold channels 105. Each of the ink ejection regions 106 is opposed to four sub manifold channels 105*a* extending in the longitudinal direction of the passage unit 9. Ink is supplied to the manifold channels 105 through ink inflow ports 105*b* formed on the upper face of the passage unit 9.

Each of the nozzles 108 communicates with a sub manifold channel 5*a* through a pressure chamber 110 and an aperture 112. In a plan view, the pressure chamber 110 has a substantially rhombic shape, and more specifically a rhombic shape having its corners rounded by curves. Nozzles 108 included in four neighboring nozzle rows which extend in the longitudinal direction of the passage unit 9 communicate with the same sub manifold channel 105*a*. In FIGS. 2 and 3, for the purpose of easy understanding, piezoelectric actuators 21 are illustrated with alternate long and two short dashes lines, while pressure chambers 110 and apertures 112 are illustrated with solid lines through they locate under the piezoelectric actuators 21 and therefore actually should be illustrated with broken lines.

Figure 4:
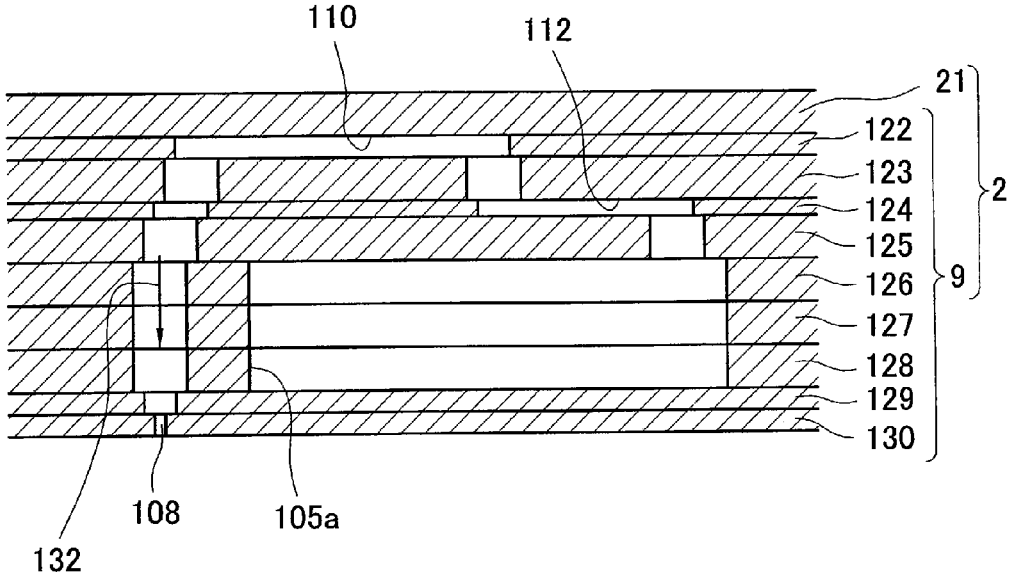
FIG. 4 is a sectional view taken along line IV-IV in FIG. 3.

Next, a cross-sectional structure of the head main body 2 will be described with reference to FIG. 4. FIG. 4 is a sectional view taken along line IV-IV in FIG. 3. As shown in FIG. 4, the head main body 2 has the passage unit 9 and the piezoelectric actuator 21 bonded to each other. The passage unit 9 has a layered structure of, from the top, a cavity plate 122, a base plate 123, an aperture plate 124, a supply plate 125, three manifold plates 126, 127, 128, a cover plate 129, and a nozzle plate 130.

These nine metal plates are positioned in layers, so that a plurality of individual ink passages 132 each extending from an exit of a sub manifold channel 105*a* through an aperture 112 and a pressure chamber 110 to a nozzle 108 is formed within the passage unit 9.

Figure 5A:
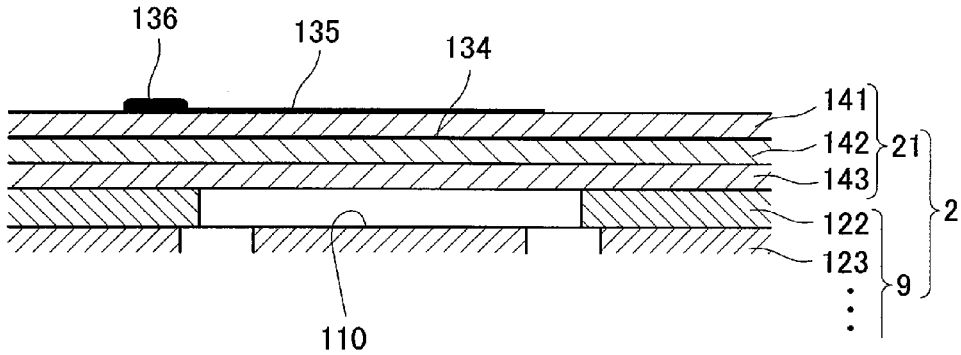
FIG. 5A is an enlarged view of a piezoelectric actuator and therearound shown in FIG. 4.
Figure 5B:
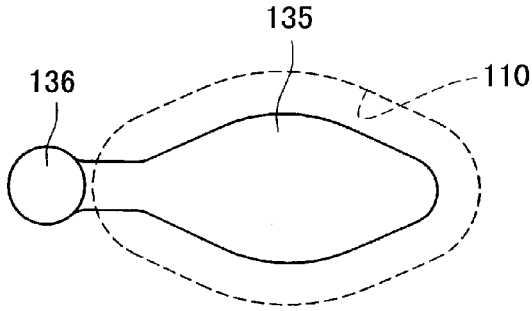
FIG. 5B is a plan view of an individual electrode shown in FIG. 5A.

Next, the piezoelectric actuator 21 will be described with reference to FIG. 5. FIG. 5A is an enlarged view of the piezoelectric actuator 21 and therearound shown in FIG. 4. FIG. 5B is an enlarged plan view of an individual electrode 135 and therearound shown in FIG. 5A. As shown in FIG. 5A, the piezoelectric actuator 21 has a layered structure of three piezoelectric sheets 141, 142, and 143. Each of the piezoelectric sheets 141 to 143 has the same thickness of approximately 15 μm, and the piezoelectric actuator 21 has the thickness of approximately 45 μm. Any of the piezoelectric sheets 141 to 143 is a laminar flat plate which is continuous so as to extend over a plurality of pressure chambers 110 formed within one ink ejection region 106 of the head main body 2. That is, the piezoelectric sheets 141 to 143 are continuous flat layers. The respective piezoelectric layers 141 to 143 are made of a lead zirconate titanate (PZT)-base ceramic material having ferroelectricity. The uppermost piezoelectric layer 141 is in advance polarized in its thickness direction.

An individual electrode 135 having a thickness of approximately 1 μm is formed on an upper face of the uppermost piezoelectric layer 141. Both of the individual electrode 135 and a later-described common electrode 134 are formed by printing a conductive paste including a conductive material such as a metal. As shown in FIG. 5B, the individual electrode 135 has, in a plan view, a substantially rhombic shape slightly smaller than the pressure chamber 110. The individual electrode 135 is formed so that it is opposed to a center of a pressure chamber 110 and at the same time its large part falls within the pressure chamber 110 in a plan view. Thus, on the uppermost piezoelectric layer 141, in a substantially whole area thereof, a plurality of individual electrodes 135 are regularly arranged in two dimensions, as shown in FIG. 3. In this embodiment, since the individual electrodes 135 are formed only on a surface of the piezoelectric actuator 21, only the piezoelectric layer 141 which is the outermost layer includes active regions which cause piezoelectric strain due to an external electric field. The other piezoelectric layers 142 and 143 do not strain by themselves. As a result, the piezoelectric actuator 21 works as an actuator which presents unimorph-type deformation, and therefore can be deformed at excellent efficiency.

One acute portion of the individual electrode 135 extends out to a position above a portion of the cavity plate 22 where no pressure chamber 110 is formed. A land 136 is provided on a distal end portion of the extending-out individual electrode 135. The land 136 has a substantially circular shape in a plan view, and has a thickness of approximately 15 μm. The land 136 is formed by printing a conductive resin paste. The individual electrode 135 and the land 136 are electrically connected to each other. The land 136 is electrically connected to an unillustrated flexible printed circuit board (FPC) through which a drive potential is applied from the control unit 16 to the individual electrode 135.

A common electrode 134 having a thickness of approximately 2 μm is formed between the uppermost piezoelectric layer 141 and the piezoelectric layer 142 disposed under the uppermost piezoelectric layer 141. The common electrode 134 is formed over an entire face of the sheet. As a result, the piezoelectric layer 141 is, in its portion opposed to the pressure chamber 110, sandwiched between a pair of electrodes, that is, the individual electrode 135 and the common electrode 134. No electrode is disposed between the piezoelectric layer 142 and the piezoelectric layer 143. The common electrode 134 is grounded in an unillustrated region. Consequently, the common electrode 134 is, in its regions corresponding to all the pressure chambers 110, equally kept at the ground potential.

Here, an operation of the piezoelectric actuator 21 will be described. The individual electrodes 135 are in advance kept at a predetermined potential. Upon every ejection request, a corresponding individual electrode 135 is once set at the ground potential and then at a predetermined timing returned to the predetermined potential again. When a drive potential is applied to an individual electrode 135, a potential difference occurs between this individual electrode 135 and the common electrode 134, and thus an electric field in a thickness direction occurs in a portion (which means an active layer) of the piezoelectric layer 141 sandwiched between this individual electrode 135 and the common electrode 134. The portion of the piezoelectric layer 141 expands in the thickness direction and contracts in a horizontal direction which is perpendicular to the thickness direction, because the direction of the electric field is the same as a polarization direction of the piezoelectric layer 141. Here, an amount of displacement involved in expansion and contraction is greater in the horizontal direction than in the thickness direction. While the active layer displaces in this way, the piezoelectric layers 142 and 143 act as constraining layers which do not displace by themselves. As a result, the piezoelectric layers 141 to 143 cause unimorph deformation protruding toward a pressure chamber 110. Accordingly, the volume of the pressure chamber 110 is reduced and thus ink pressure in the pressure chamber 110 rises. That is, ink ejection energy is applied to ink contained in the pressure chamber 110.

Figure 6A:
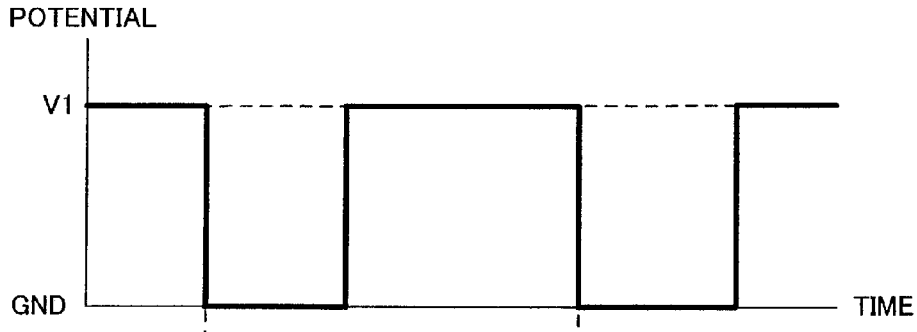
FIG. 6A shows a first waveform signal in ejecting an ink droplet, which is a drive waveform signal outputted to the individual electrode shown in FIG. 5A.

Here, in this embodiment, for ejecting an ink droplet from a corresponding nozzle 108, a pulse waveform signal (first waveform signal) as shown in FIG. 6A is outputted from a later-described waveform signal output circuit 157 (see FIG. 7) to an individual electrode 135. The first waveform signal is a pulse waveform signal changing between a potential V1 and the ground potential. The first waveform signal is in advance kept at the potential V1, and makes a following change once within a printing cycle in which one ink droplet is ejected. That is, in the change, the first waveform signal is once kept at the ground potential for a predetermined period of time and then returned to the potential V1 again. The potential V1 which is a pulse height and the predetermined period of time which is a pulse width are set to such values that, when an individual electrode 135 is kept at the ground potential and then set at the potential V1, an ink droplet is ejected from a nozzle 108 as mentioned above. Thereby, an ink droplet is ejected from a nozzle 108 corresponding to the individual electrode 135 to which the first waveform signal has been outputted.

Figure 6B:
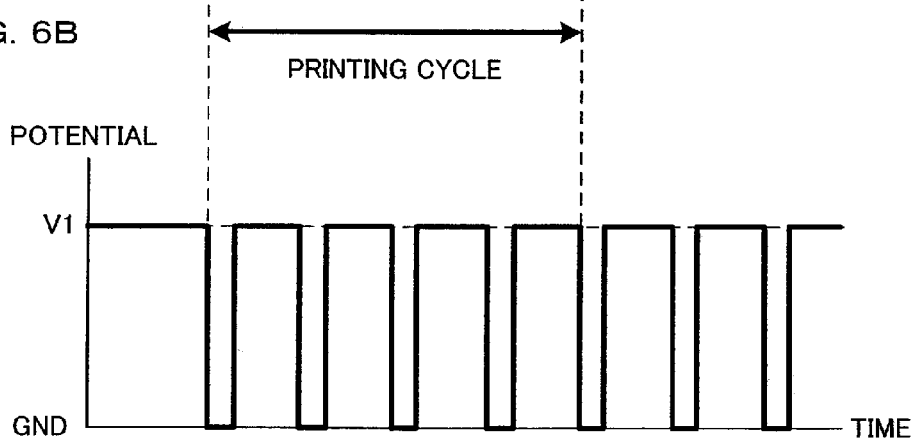
FIG. 6B shows a second waveform signal in performing a non-ejection flushing, which is a drive waveform signal outputted to the individual electrode shown in FIG. 5A.

On the other hand, a non-ejection flushing is performed in this embodiment. For performing a non-ejection flushing, a pulse waveform signal (second waveform signal) as shown in FIG. 6B is outputted from a later-described waveform signal output circuit 157 (see FIG. 7) to an individual electrode 135. The second waveform signal is, like the first waveform signal, a pulse waveform signal changing between a potential V1 and the ground potential. The second waveform signal is in advance kept at the potential V1, and makes a following change a plurality of times within the printing cycle. Thus, the second waveform signal has a pulse width and a pulse interval smaller than those of the first waveform signal. The pulse width and the pulse interval of the second waveform signal are determined in such a manner that a time involved is shorter than a time required until displacement of the actuator is completed. That is, the pulse width of the second waveform signal is shorter than a time for discharging electric charge which is produced when the ground potential is applied to each actuator. The pulse interval is equal to or longer than, in addition to the discharge time (the pulse width), a time for completing a charge subsequent to the discharge of electric charge. As a result, prior to reaching complete displacement, the actuator returns to its original state which means a state before occurrence of an ejection request where the actuator is kept at the predetermined potential. This causes a small change in pressure of ink contained in the pressure chamber 110 due to displacement of the actuator. Therefore, no ink droplet is ejected from a nozzle 108, but ink existing around the nozzle 108 is stirred. That is, a non-ejection flushing is performed.

Figure 7:
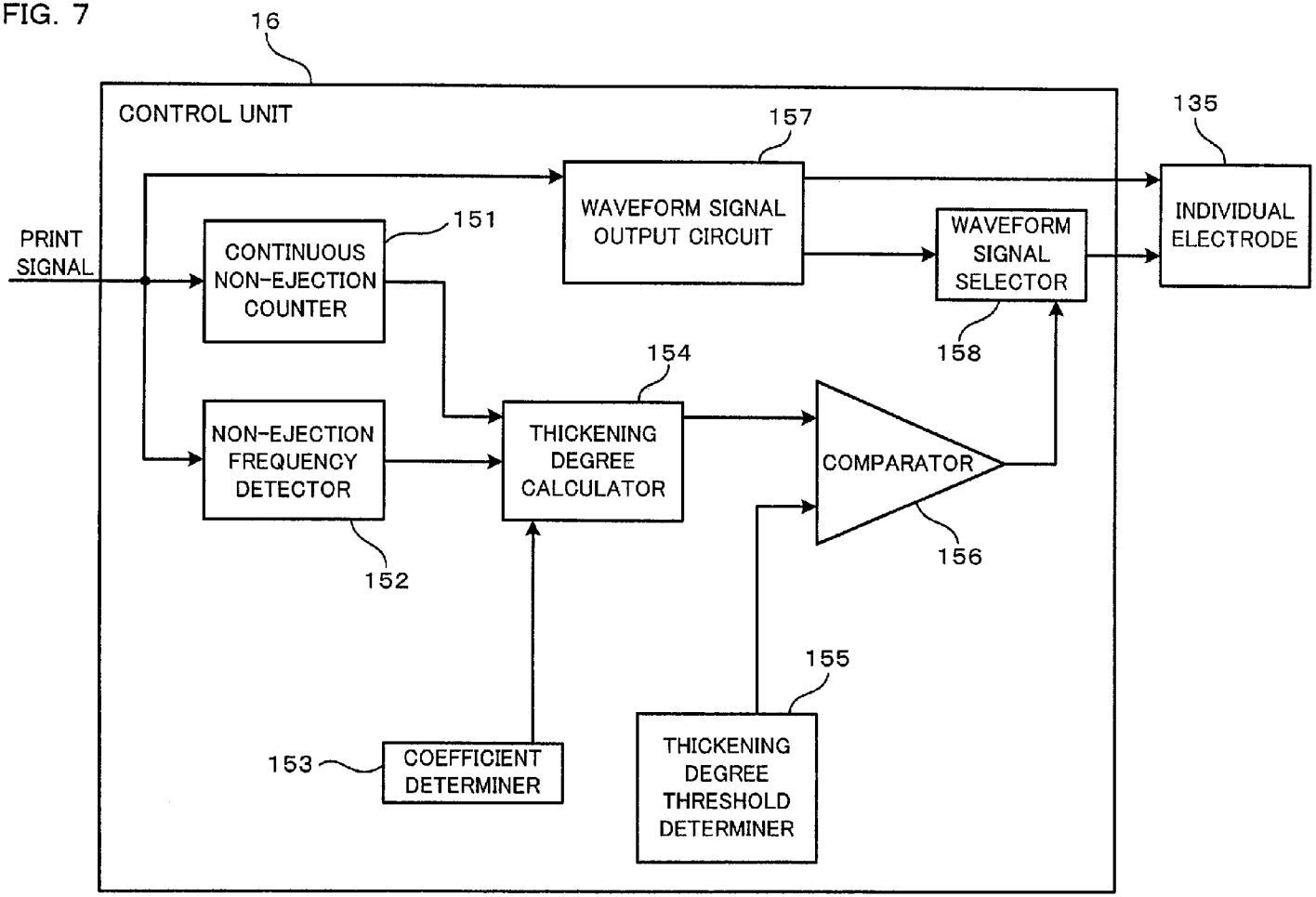
FIG. 7 is a block diagram of a control unit shown in FIG. 1.
Figure 8:
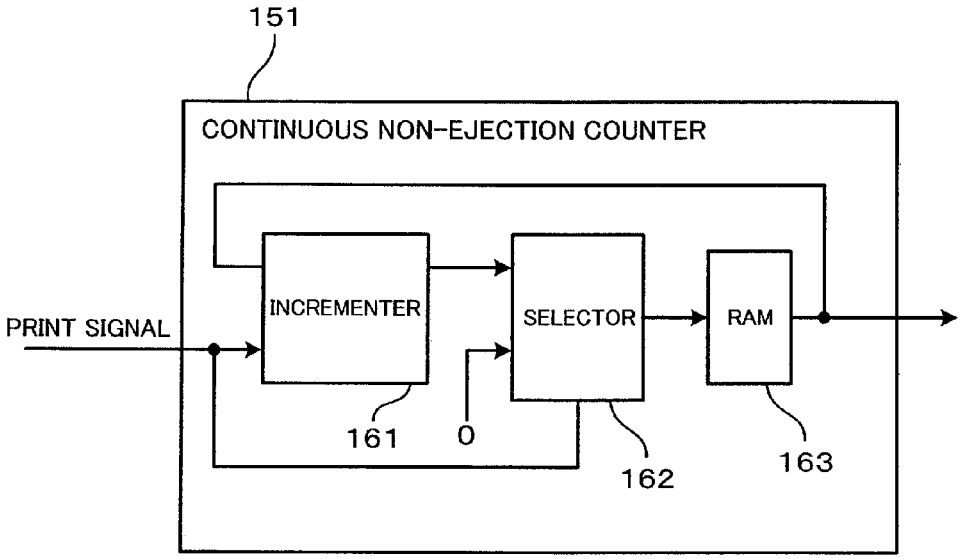
FIG. 8 is a block diagram of a continuous non-ejection counter shown in FIG. 7.
Figure 9:
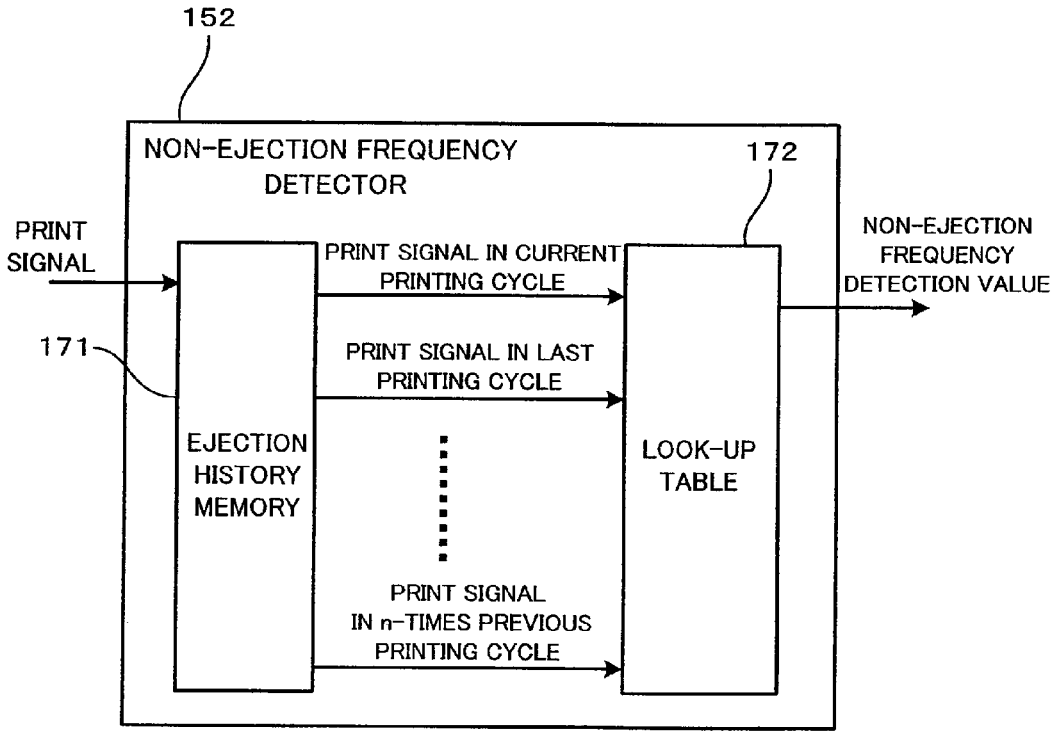
FIG. 9 is a block diagram of a non-ejection frequency detector shown in FIG. 7.
Figure 10:
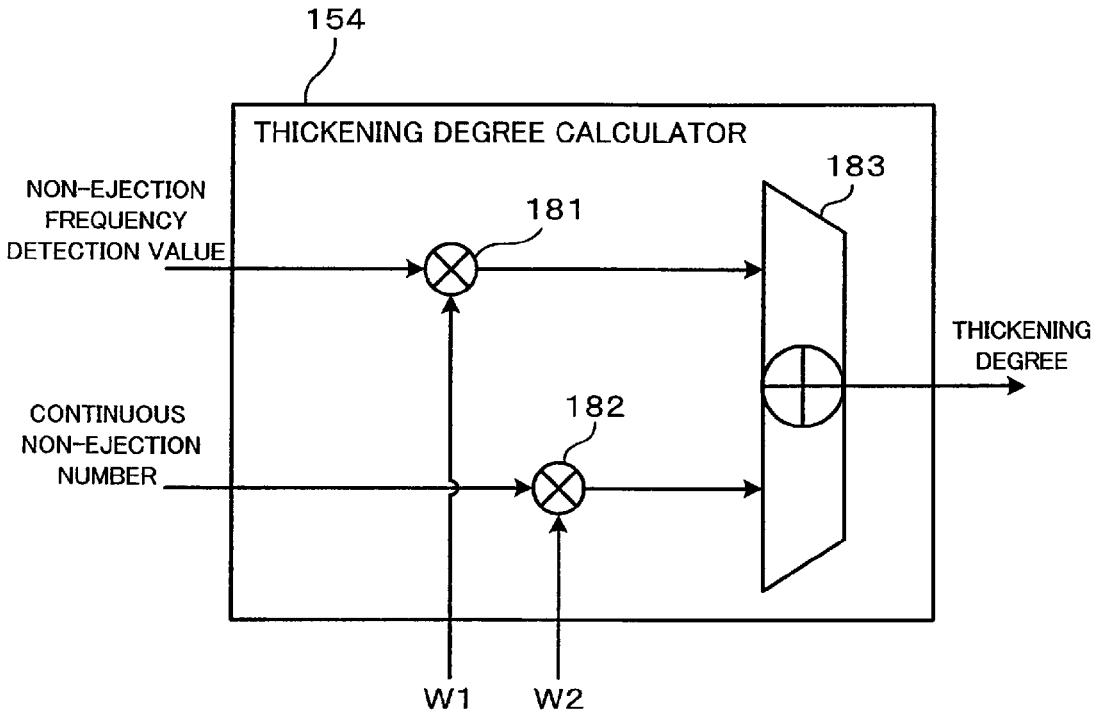
FIG. 10 is a block diagram of a thickening degree calculator shown in FIG. 7.

Next, the control unit 16 will be described with reference to FIGS. 7 to 10. FIG. 7 is a block diagram of the control unit 16. FIG. 8 is a block diagram of a continuous non-ejection counter 151 shown in FIG. 7. FIG. 9 is a block diagram of a non-ejection frequency detector 152 shown in FIG. 7. FIG. 10 is a block diagram of a thickening degree calculator 154 shown in FIG. 7. The control unit 16 is made up of a CPU (Central Processing Unit), a ROM (Read Only Memory), a RAM (Random Access Memory), and the like. These components function as respective parts described below. The control unit 16 includes respective parts shown in FIGS. 7 to 10. The number of each of the parts is equivalent to the number of nozzles 108. However, only one of them is illustrated in FIGS. 7 to 10 for convenience of explanation. In performing a printing, for every printing cycle described above, a print signal is inputted to a continuous non-ejection counter 151, a non-ejection frequency detector 152, and a waveform signal output circuit 157. The print signal corresponds to each of the plurality of nozzles 108, and indicates whether or not to eject an ink droplet.

As shown in FIG. 7, the control unit 16 includes a continuous non-ejection counter 151, a non-ejection frequency detector 152, a coefficient determiner 153, a thickening degree calculator 154, a thickening degree threshold determiner 155, a comparator 156, a waveform signal output circuit 157, and a waveform signal selector 158. A print signal indicating, for each of a plurality of nozzles 108, whether or not to eject an ink droplet is inputted to the control unit 16.

During a printing, the continuous non-ejection counter 151 counts a continuous non-ejection number which means the number of printing cycles during which non-ejection of an ink droplet from the nozzle 108 continues until the latest printing cycle. As shown in FIG. 8, the continuous non-ejection counter 151 includes an incrementer 161, a selector 162, and a RAM 163. As a print signal is inputted, the incrementer 161 adds 1 to a continuous non-ejection number stored in the RAM 163, and outputs a resulting value to the selector 162. When an inputted print signal indicates non-ejection of an ink droplet, the selector 162 rewrites a continuous non-ejection number stored in the RAM 163 into the value resulting from addition of 1 by the incrementer 161. When an inputted print signal indicates an ejection of an ink droplet, the selector 162 rewrites a continuous non-ejection number stored in the RAM 163 into 0.

Based on a current print signal and last n print signals, that is, based on a sequence of n+1 print signals, the non-ejection frequency detector 152 determines a non-ejection frequency detection value which indicates a frequency of non-ejection of an ink droplet from the nozzle 108. As shown in FIG. 9, the non-ejection frequency detector 152 includes an ejection history memory 171 and a look-up table 172. The ejection history memory 171 stores therein print signals inputted in a current printing cycle and last n printing cycles, that is, an ejection history of whether ink droplets have been ejected or not. The look-up table 172 stores therein a non-ejection frequency detection value which corresponds to a pattern of print signals inputted in a current printing cycle and last n printing cycles. The non-ejection frequency detector 152 outputs, to the thickening degree calculator 154, a non-ejection frequency detection value which is stored in the look-up table 172 and corresponds to a pattern of print signals stored in the ejection history memory 171. Here, in the look-up table 172, the non-ejection frequency detection value increases as an occurrence pattern of a printing cycle during which no ink droplet was ejected in a current printing cycle and last n printing cycles is such a pattern that a viscosity of ink contained in the nozzle 108 is more likely to increase. Here, an occurrence pattern of a printing cycle during which no ink droplet was ejected which is likely to increase a viscosity of ink means, for example, an occurrence pattern in which, within a current printing cycle and last n printing cycles, a printing cycle during which no ink droplet occurs at a high frequency. Like this, the look-up table 172 stores therein a non-ejection frequency detection value which corresponds to a pattern of print signals inputted in a current printing cycle and last n printing cycles. Accordingly, the non-ejection frequency detector 152 can quickly determine a non-ejection frequency detection value.

The coefficient determiner 153 determines values of a first coefficient W1 and a second coefficient W2, which are values indicating a degree which a non-ejection frequency detection value and a continuous non-ejection number influence to a thickening of ink in the nozzle 108 respectively. Each of the first coefficient W1 and the second coefficient W2 is determined based on a kind of ink ejected from the nozzle 108, a structural characteristic value for the ink-jet head 1, and the like. The first coefficient W1 and the second coefficient W2 are set higher as a non-ejection frequency detection value and a continuous non-ejection number have a greater influence on a thickening of ink in the nozzle 108 respectively.

The thickening degree calculator 154 calculates a thickening degree which indicates a degree of thickening of ink in the nozzle 108. As shown in FIG. 10, the thickening degree calculator 154 has two multipliers 181 and 182, and an adder 183. The multiplier 181 outputs, to the adder 183, a value resulting from multiplying a non-ejection frequency detection value by the first coefficient W1. The multiplier 182 outputs, to the adder 183, a value resulting from multiplying a continuous non-ejection number by the second coefficient W2. The adder 183 adds the values outputted from the multipliers 181 and 182 to each other to thereby calculate a thickening degree, and outputs the thickening degree to the comparator 156. Therefore, an arithmetic operation performed by the thickening degree calculator 154 for calculating a thickening degree includes a calculation of multiplying a non-ejection frequency detection value by the first coefficient W1 and a calculation of multiplying a continuous non-ejection number by the second coefficient W2.

Like this, a thickening degree of the nozzle 108 is calculated based on the non-ejection frequency detection value and the continuous non-ejection number. Therefore, a thickening degree can be accurately obtained. Moreover, the non-ejection frequency detection value and the continuous non-ejection number are multiplied respectively by the first coefficient W1 and the second coefficient W2 which have been determined based on a temperature of the ink-jet head 1, a kind of ink ejected from the nozzle 108, and a manufacture characteristic value for the ink-jet head 1. Then, resulting values are added to each other, to thereby calculate a thickening degree. Therefore, a thickening degree can be more accurately obtained.

The thickening degree threshold determiner 155 determines a thickening degree threshold which serves as a reference for determining whether or not to perform a non-ejection flushing in a nozzle 108 which does not eject an ink droplet. The comparator 156 compares a thickening degree value and the thickening degree threshold with each other. When the thickening degree value is equal to or greater than the thickening degree threshold, the comparator 156 outputs a non-ejection flushing command signal to the waveform signal selector 158. The non-ejection flushing command signal indicates that a non-ejection flushing should be performed.

The waveform signal output circuit 157 outputs a drive waveform signal for applying a drive potential to the individual electrode 135 of the piezoelectric actuator 21. When a print signal indicating that an ink droplet should be ejected from the nozzle 108 is inputted, the waveform signal output circuit 157 outputs the above-described first waveform signal shown in FIG. 6A to the individual electrode 135.

When a print signal indicating that an ink droplet should not be ejected from the nozzle 108 is inputted, the waveform signal output circuit 157 generates the above-described second waveform signal shown in FIG. 6B and outputs the second waveform signal to the waveform signal selector 158. When the second waveform signal is inputted, the waveform signal selector 158 outputs the second waveform signal to the individual electrode 135 in a case where the non-ejection flushing command signal has been inputted from the comparator 156, and does not output the drive waveform signal to the individual electrode 135 in a case where the non-ejection flushing command signal has not been outputted.

Since the control unit 16 controls an operation of the ink-jet head 1 in this manner, every printing cycle during a printing, an ink droplet necessary for the printing is ejected from a nozzle 108 while a non-ejection flushing is performed in a nozzle 108 which has to eject no ink droplet and in addition has an increased thickening degree of ink therein. Accordingly, ink contained in a nozzle 108 which is less often used during the printing is stirred, and therefore thickening thereof can be restrained. As a result, a delay in ejection of an ink droplet from the nozzle 108 hardly occurs, to allow a high-quality image to be formed on a recording paper P.

In the above-described embodiment, for every nozzle 108, a thickening degree of the nozzle 108 is determined based on print signals inputted in the current printing cycle and the last n printing cycles which are stored in the ejection history memory 171 of the non-ejection frequency detector 152. Therefore, a thickening degree of each nozzle 108 can be accurately obtained. When a thickening degree of ink contained in a nozzle 108 becomes equal to or greater than the thickening degree threshold, the waveform signal selector 158 applies the second waveform signal to an individual electrode 135 corresponding to the nozzle 108. Thereby, a non-ejection flushing is performed, and the ink contained in the nozzle 108 is stirred, to reduce the thickening degree of the ink. As a result, a delay in ejection of an ink droplet from the nozzle 108 hardly occurs, to allow a high-quality image to be formed on a recording paper P.

The thickening degree calculator 154 calculates a thickening degree by adding values resulting from a multiplication of the non-ejection frequency and the continuous non-ejection number respectively by the first coefficient W1 and the second coefficient W2 which have been determined based on a temperature of the ink-jet head 1, a kind of ink ejected from the nozzle 108, and a manufacture characteristic value for the ink-jet head 1. Therefore, a more accurate thickening degree can be obtained because a thickening degree is determined in consideration of the temperature of the ink-jet head 1, the kind of ink ejected from the nozzle 108, and the structural characteristic value for the ink-jet head 1.

The non-ejection frequency detector 152 stores, in the look-up table 172, a non-ejection frequency detection value which corresponds to the current printing signal and the last n printing signals. Therefore, the non-ejection frequency detector 152 can quickly determine a non-ejection frequency detection value.

Figures 11A, 11B:
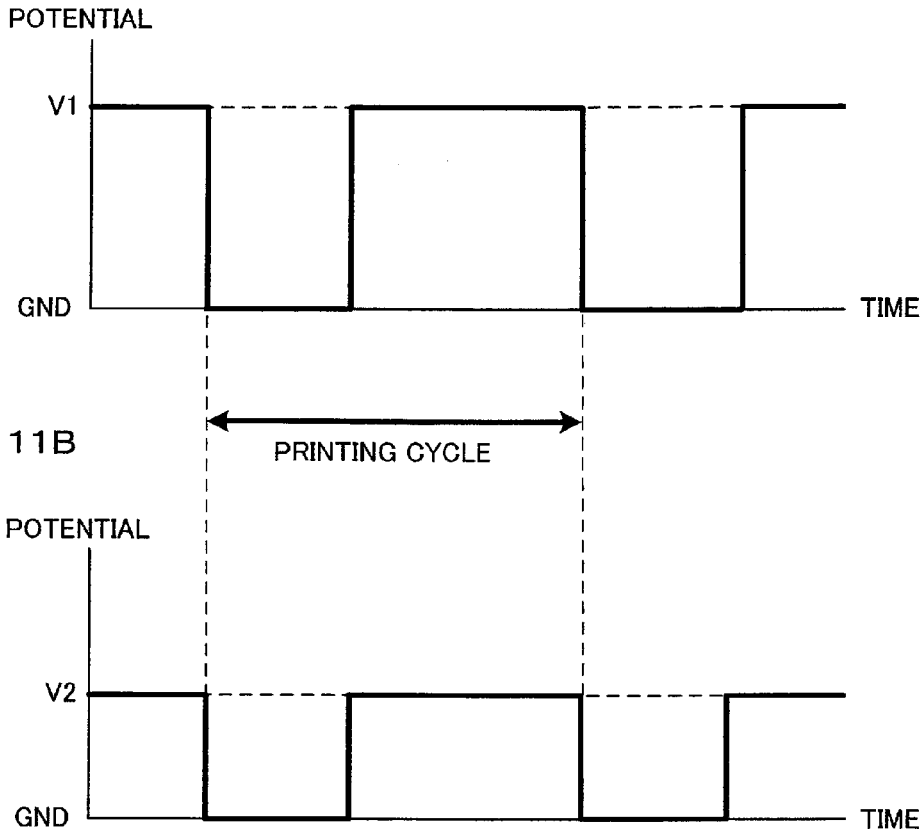
FIG. 11A is a counterpart of FIG. 6A, showing a modification of the first embodiment.
FIG. 11B is a counterpart of FIG. 6B, showing the modification of the first modification.

In this embodiment, the first waveform signal and the second waveform signal have the same potential value which is a pulse height, and different pulse widths and different pulse intervals. However, it may be possible that the first waveform signal is a waveform signal shown in FIG. 11A and the second waveform signal is a waveform signal shown in FIG. 11B. The waveform signal shown in FIG. 11A is the same as shown in FIG. 6A. The waveform signal shown in FIG. 11B has the same pulse width and the same pulse interval as those of the first waveform signal. The waveform shown in FIG. 11B is in advance kept at a potential V2 which is lower than the potential V1 of the first waveform signal, and then repeatedly makes a following change. That is, in the change, the waveform signal is kept at the ground potential and then returned to the potential V2 again. In such a case, like in the embodiment, when the first waveform signal is outputted to the individual electrode 135, an ink droplet is ejected from the nozzle 108, while when the second waveform signal is outputted to the individual electrode 135, an ink droplet is not ejected from the nozzle 108 but ink existing around the nozzle 108 is stirred so that a non-ejection flushing is performed, because the potential V2 is lower than the potential V1 and therefore an amount of deformation of the piezoelectric layers 141 to 143 is smaller. In a non-ejection flushing according to this potential control as well, each pulse may have a pulse width smaller than that of the first waveform, in terms of stirring ink more often.

In this embodiment, the control unit 16 includes the respective parts shown in FIGS. 7 to 10, and the number of each of the parts is equivalent to the number of nozzles 108, so that the respective parts shown in FIGS. 7 to 10 control an ejection of an ink droplet and a non-ejection flushing from one nozzle 108. However, the respective parts shown in FIGS. 7 to 10 may control ink ejections and non-ejection flushings from a plurality of nozzles 108. In such a case, the respective parts of the control unit 16 perform the same control as in the embodiment, a plurality of times with time lags so as to correspond to the respective nozzles 108. In every control, the respective parts output the first or second waveform signal from the waveform signal output circuit 157 to a corresponding individual electrode 135.

The first and second waveform signals are in advance kept at the potential V1 and then repeat a change between the potential V1 and the ground potential. However, they may be in advance kept at the ground potential and then repeat a change between the potential V1 and the ground potential.

Next, a second preferred embodiment of the present invention will be described. A printer according to the second embodiment has the same construction as that of the first embodiment, except that its control unit 216 which will be described later is different from the control unit 16 according to the first embodiment. Therefore, descriptions of the same parts as in the first embodiment will be omitted here.

A method of driving a piezoelectric actuator 21 in the second embodiment will be described. In the second embodiment, the individual electrodes 135 are in advance kept at the ground potential. When a drive potential is applied to an individual electrode 135, a potential difference occurs between this individual electrode 135 and the common electrode 134, and thus an electric field in a thickness direction occurs in a portion of the piezoelectric layer 141 sandwiched between this individual electrode 135 and the common electrode 134. When a direction of the electric field is substantially the same as a polarization direction, the portion of the piezoelectric layer 141 contracts in a horizontal direction which is perpendicular to the thickness direction. At this time, the piezoelectric layers 142 and 143 act as constraining layers which do not displace by themselves. As a result, the piezoelectric layers 141 to 143 cause unimorph deformation protruding toward a pressure chamber 110. Accordingly, a volume of the pressure chamber 110 is reduced and thus ink pressure in the pressure chamber 110 rises. That is, ink ejection energy is applied to ink contained in the pressure chamber 110. Here, in a case where a value of the drive potential is high and therefore an amount of deformation of the piezoelectric layers 141 to 143 is large, ink pressure rises a lot so that a large ink droplet is ejected from a nozzle 108 which communicates with the pressure chamber 110. On the other hand, in a case where a value of the drive potential is low and therefore an amount of deformation of the piezoelectric layers 141 to 143 is small, ink pressure does not rise very much so that a small ink droplet is ejected from the nozzle 108. That is to say, under the same ink viscosity, the higher a drive potential is, the larger amount of deformation the piezoelectric actuator 21 shows and therefore the larger amount of ink is ejected at once time.

Figure 12:
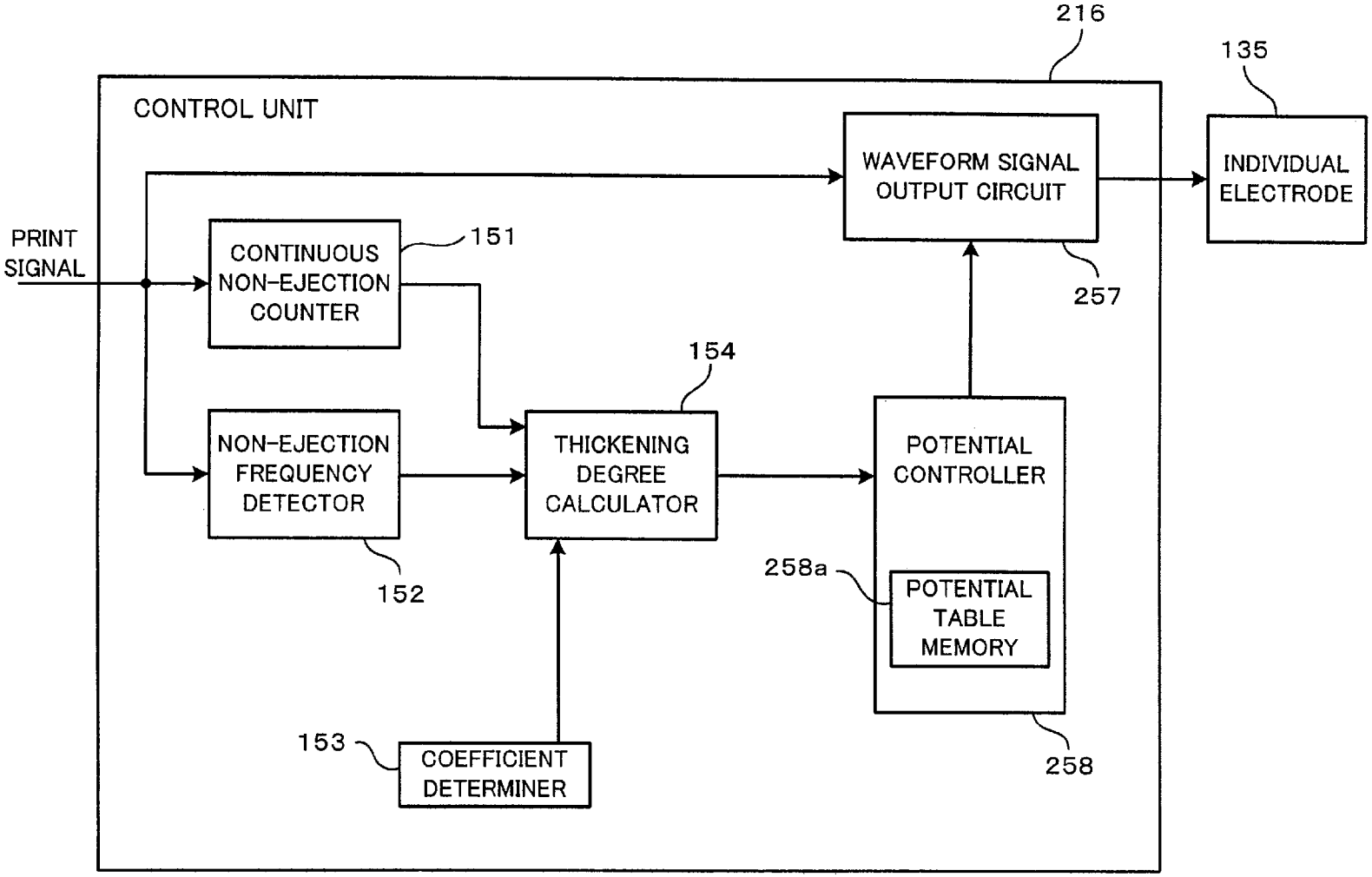
FIG. 12 is a counterpart of FIG. 7 and a block diagram showing a second embodiment.

Next, the control unit 216 will be described with reference to FIG. 12 and FIGS. 8 to 10. FIG. 12 is a block diagram of the control unit 216. The control unit 216 is made up of a CPU (Central Processing Unit), a ROM (Read Only Memory), a RAM (Random Access Memory), and the like. These components function as respective parts described below. The control unit 216 includes respective parts shown in FIG. 12 and FIGS. 8 to 10. The number of each of the parts is equivalent to the number of nozzles 108. However, only one of them is illustrated in FIG. 12 and FIGS. 8 to 10 for convenience of explanation. In performing a printing, for every printing cycle described above, a print signal is inputted to a continuous non-ejection counter 151, a non-ejection frequency detector 152, and a waveform signal output circuit 257. The print signal corresponds to each of the plurality of nozzles 108, and indicates whether or not to eject an ink droplet.

As shown in FIG. 12, the control unit 216 includes a continuous non-ejection counter 151, a non-ejection frequency detector 152, a coefficient determiner 153, a thickening degree calculator 154, a waveform signal output circuit 257, and a potential control circuit 258. A print signal indicating, for each of a plurality of nozzles 108, whether or not to eject an ink droplet is inputted to the control unit 216.

During a printing, the continuous non-ejection counter 151 counts a continuous non-ejection number which means the number of printing cycles during which non-ejection of an ink droplet from the nozzle 108 continues until the latest printing cycle. The continuous non-ejection counter 151 has a construction as shown in FIG. 8, which is the same as in the first embodiment. Therefore, a specific description of the continuous non-ejection counter 151 will be omitted here.

Based on a current print signal and last n print signals, that is, based on a sequence of n+1 print signals, the non-ejection frequency detector 152 determines a non-ejection frequency detection value which indicates a frequency of non-ejection of an ink droplet from the nozzle 108. The non-ejection frequency detector 152 has a construction as shown in FIG. 9, which is the same as in the first embodiment. Therefore, a specific description of the non-ejection frequency detector 152 will be omitted here.

Like in the first embodiment, the coefficient determiner 153 determines values of a first coefficient W1 and a second coefficient W2, which are values indicating a degree to which a non-ejection frequency detection value and a continuous non-ejection number influence a thickening of ink in the nozzle 108 respectively.

The thickening degree calculator 154 calculates a thickening degree which indicates a degree of thickening of ink in the nozzle 108. The thickening degree calculator 154 has a construction as shown in FIG. 10, which is the same as in the first embodiment. Therefore, a specific description of the thickening degree calculator 154 will be omitted here.

Figure 13A:
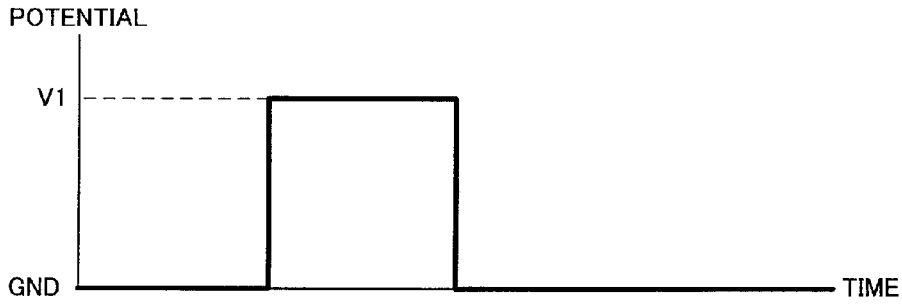
FIG. 13A is a schematic view showing a normal drive waveform signal outputted from a waveform signal output circuit shown in FIG. 12.

The waveform signal output circuit 257 outputs a drive waveform signal for applying a drive potential to the individual electrode 135 of the piezoelectric actuator 21. FIG. 13 illustrates a drive waveform which is outputted from the waveform signal output circuit 257. When a print signal indicating that an ink droplet should be ejected from the nozzle 108 is inputted, the waveform signal output circuit 257 generates, as a normal drive waveform signal for ejecting an ink droplet from the nozzle 108, a waveform signal having a pulse at the potential V1 as shown in FIG. 13A and outputs the waveform signal to a corresponding individual electrode 135. This pulse waveform signal is used in ejecting one ink droplet. The pulse waveform signal is in advance kept at the ground potential, and makes a following change once. That is, in the change, the pulse waveform signal is once kept at the potential V1 for a predetermined period of time and then returned to the ground potential again. Here, the potential V1 is set to such a value that, in a condition that ink has a normal viscosity, a predetermined amount of ink is ejected by application of the potential V1 to the individual electrode 135.

Figure 13B:
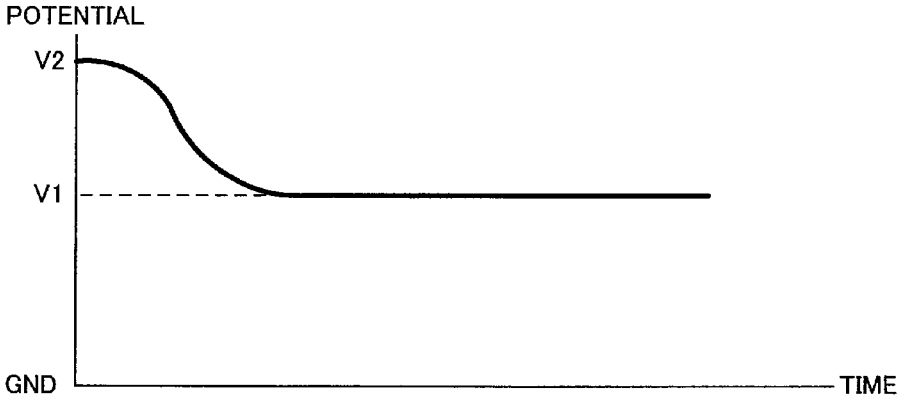
FIG. 13B is a schematic view showing an initial potential outputted from the waveform signal output circuit shown in FIG. 12 and a subsequent potential change.

Based on an ink thickening degree in the nozzle 108 which has been outputted from the thickening degree calculator 154, the potential controller 258 controls a potential of a drive waveform signal which will be outputted from the waveform signal output circuit 257. To be more specific, the potential controller 258 controls a potential of a drive waveform signal in such a manner that an initial potential of the drive waveform signal, which is a drive potential at a time when outputting of the drive waveform signal starts, is highest as shown in FIG. 13B. FIG. 13B schematically illustrates how a potential of each pulse subsequent an initial potential changes in a condition that the initial potential is V2 (V2>V1). The later a pulse comes, the lower its potential becomes than V2. Through a predetermined period of time or a predetermined number of pulses, the potential converges to the potential V1. The potential controller 258 shown in FIG. 12 has a potential table memory 258*a* in which an ink thickening degree and an initial potential corresponding to each thickening degree are stored as a table. In the table, a higher initial potential corresponds to a greater thickening degree. The potential controller 258 refers to the table stored in the potential table memory 258*a*, to thereby determine an initial potential corresponding to a thickening degree which has been outputted from the thickening degree calculator 154. Then, the potential controller 258 makes a control so that the waveform signal output circuit 257 outputs the determined initial potential as a drive potential. Several levels of initial potentials have been prepared corresponding to respective thickening degrees. A drive waveform signal is such that, with a higher initial potential, a potential stays higher than V1 for a longer period of time. As a potential stays higher than V1 for a longer period of time, the piezoelectric actuator 21 presents a larger unimorph deformation for a longer period of time, as compared with when a normal drive waveform is outputted to the individual electrode 135. As a consequence, larger ink ejection energy is applied to a pressure chamber 110. Therefore, even though ink contained in the nozzle 108 is thickened to a great degree, a delay in ejection of an ink droplet can be restrained. In addition, a volume of the ink droplet is equivalent to a volume of an ink droplet having a normal viscosity.

In the above-described embodiment, the non-ejection frequency detector 152 detects a non-ejection frequency for every nozzle 108 based on an ejection history stored in the ejection history memory 171, and the thickening degree calculator 154 determines a thickening degree of ink contained in a nozzle 108 based on a continuous non-ejection number and the non-ejection frequency concerning every nozzle 108. Therefore, a thickening degree of each nozzle 108 can be accurately obtained. When ejecting an ink droplet from a nozzle 108, the potential controller 258 controls the waveform signal output circuit 257 in such a manner that, as a thickening degree concerning a nozzle 108 is greater, a drive waveform signal for ejecting an ink droplet from the nozzle 108 has a higher initial potential. Therefore, even though ink contained in the nozzle 108 is thickened to a great degree, an ejection of an ink droplet from the nozzle 108 is hardly delayed. Thus, a high-quality image can be formed on a recording paper P.

In particular, the potential controller 258 controls the waveform signal output circuit 257 in such a manner that a initial potential of a drive waveform signal is highest. This enables a thickened ink droplet to be efficiently ejected from a nozzle 108.

Moreover, the potential controller 258 determines an initial potential by referring to the potential table memory 258*a*. Therefore, an initial potential can be determined quickly.

Besides, the thickening degree calculator 154 calculates a thickening degree by correcting a non-ejection frequency and a continuous non-ejection number respectively by the first coefficient W1 and the second coefficient W2 which are determined based on a temperature of the ink-jet head 1, a kind of ink ejected from a nozzle 108, and a manufacture characteristic value for the ink-jet head 1. Therefore, a more accurate thickening degree can be obtained because a thickening degree is determined in consideration of the temperature of the ink-jet head 1, the kind of ink ejected from the nozzle 108, and the structural characteristic value for the ink-jet head 1.

Further, the non-ejection frequency detector 152 stores, in the look-up table 172, a non-ejection frequency detection value which corresponds to the current printing signal and the last n printing signals. Therefore, the non-ejection frequency detector 152 can quickly determine a non-ejection frequency detection value.

Figure 14:
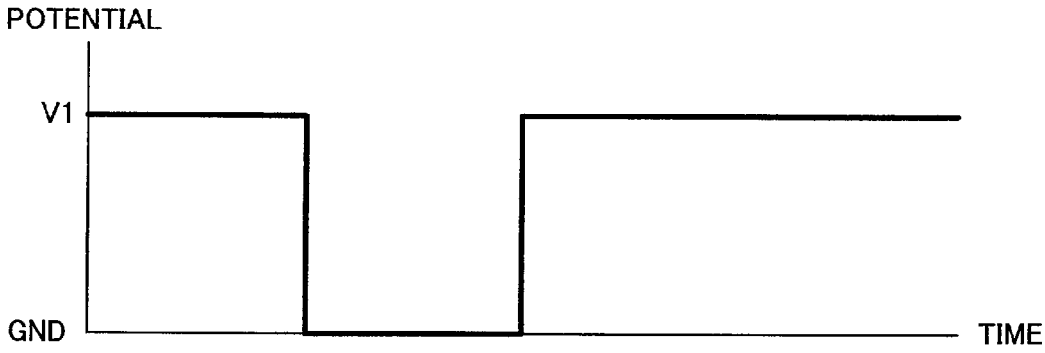
FIG. 14 illustrates a waveform signal outputted from the waveform signal output circuit of a modification of the second embodiment.

In this embodiment, in one printing cycle, the drive waveform signal changes from the ground potential to the potential V1, as shown in FIG. 13A. However, on the contrary, it may also be possible that a drive waveform signal is in advance kept at the potential V1, then once kept at the ground potential for a predetermined period of time, and then returned to the potential V1 again, as shown in FIG. 14. In such a case, an ink droplet is ejected at a timing when the waveform signal returns from the ground potential to the potential V1 again. Accordingly, in a case where ink is thickened, a potential value is varied as shown in FIG. 13B at a time when the potential value is returning from the ground potential. More specifically, the above-described initial potential V2 is applied at a time when the potential, which has been kept in advance at the potential V1 and then once kept at the ground potential for a predetermined period of time, returns to the predetermined potential again. In a subsequent drive waveform signal, the potential returning from the ground potential gradually approaches the potential V1.

In the first and second embodiment, the first coefficient W1 and the second coefficient W2 are determined based on a temperature of the ink-jet head 1, a kind of ink ejected from the nozzle 108, and a manufacture characteristic value for the ink-jet head 1. However, a first coefficient and a second coefficient may be determined based on only some of them.

In addition, in the first and second embodiment, the arithmetic operation performed by the thickening degree calculator 154 for calculating a thickening degree includes a calculation of multiplying a non-ejection frequency detection value by the first coefficient W1 and a calculation of multiplying a continuous non-ejection number by the second coefficient W2. However, a thickening degree may be calculated by an arithmetic operation including only one of the calculations. Alternatively, an arithmetic operation performed for calculating a thickening degree may include neither of the calculations, and a thickening degree may be determined by another calculation using a non-ejection frequency detection value and a continuous non-ejection number.

In the first and second embodiments, further, in the non-ejection frequency detector 152, a non-ejection frequency detection value which is stored in the look-up table 172 is outputted correspondingly to print signals inputted in the current printing cycle and the last n printing cycles which are stored in the ejection history memory 171. However, this is not limitative. It may be possible that, in the non-ejection frequency detector 152, a non-ejection frequency is calculated based on print signals inputted in the current printing cycle and the last n printing cycles which are stored in the ejection history memory 171.

In the first and second embodiments described above, the present invention is applied to the printer 101 having the line-type ink-jet heads 1. However, the present invention is also applicable to printers having constructions different from that of the embodiment.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

an ink-jet head having a passage unit in which formed are a plurality of individual ink passages each extending from an exit of a common ink chamber through a pressure chamber to a nozzle, and an ejection energy applier which applies ink ejection energy to ink contained in the pressure chamber;

a conveyance mechanism which moves a recording medium relative to the ink-jet head;

a waveform signal output circuit which selectively outputs, to the ejection energy applier unit, either one of a first waveform signal including a pulse for driving the energy applier so as to make an ink droplet ejected from the nozzle and a second waveform signal including a pulse for driving the ejection energy applier so as not to make an ink droplet ejected from the nozzle;

a continuous non-ejection counter which counts, for each nozzle, a continuous non-ejection number which means the number of printing cycles during which non-ejection of an ink droplet from the nozzle continues until a latest printing cycle, where a printing cycle is a time required for a relative movement of the recording medium by a unit distance which corresponds to a printing resolution of an image to be formed;

an ejection history memory which stores therein, for each nozzle, an ejection history of whether an ink droplet has been ejected from the nozzle or not in each of a predetermined number of continuous printing cycles up to the latest printing cycle;

a non-ejection frequency detector which detects, for each nozzle, a non-ejection frequency which corresponds to an occurrence pattern of, in the ejection history stored in the ejection history memory, the printing cycle during which an ink droplet has not been ejected from the nozzle;

a thickening degree determiner which determines, for each nozzle, a thickening degree of ink in the nozzle based on the continuous non-ejection number counted by the continuous non-ejection counter and the non-ejection frequency detected by the non-ejection frequency detector; and a waveform signal selector which makes the waveform signal output circuit output the second waveform signal to the ejection energy applier corresponding to a nozzle, when an ink droplet is not ejected from the nozzle in the current printing cycle and in addition a thickening degree in the nozzle determined by the thickening degree determiner is equal to or greater than a predetermined value.

2. The ink-jet recording apparatus according to claim 1, wherein an arithmetic operation performed by the thickening degree determiner for determining the thickening degree includes a calculation of multiplying the non-ejection frequency by a first coefficient which is determined based on at least any one of a temperature of the ink-jet head, a kind of ink to be ejected from the nozzle, and a manufacture characteristic value for the ink-jet head.

3. The ink-jet recording apparatus according to claim 1, wherein an arithmetic operation performed by the thickening degree determiner for determining the thickening degree includes a calculation of multiplying the continuous non-ejection number by a second coefficient which is determined based on at least any one of a temperature of the ink-jet head, a kind of ink to be ejected from the nozzle, and a manufacture characteristic value for the ink-jet head.

4. The ink-jet recording apparatus according to claim 1, wherein the non-ejection frequency detector includes a table memory which stores therein a table indicating a relation between an occurrence pattern of the printing cycle and a non-ejection frequency associated with the occurrence pattern.

5. An ink-jet recording apparatus comprising:

an ink-jet head having a passage unit in which formed are a plurality of individual ink passages each extending from an exit of a common ink chamber through a pressure chamber to a nozzle, and an ejection energy applier which applies ink ejection energy to ink contained in the pressure chamber;

a conveyance mechanism which moves a recording medium relative to the ink-jet head;

a waveform signal output circuit which outputs, to the ejection energy applier, a waveform signal including a pulse for driving the ejection energy applier so as to make an ink droplet ejected from the nozzle;

a continuous non-ejection counter which counts, for each nozzle, a continuous non-ejection number which means the number of printing cycles during which non-ejection of an ink droplet from the nozzle continues until a latest printing cycle, where a printing cycle is a time required for a relative movement of the recording medium by a unit distance which corresponds to a printing resolution of an image to be formed;

an ejection history memory which stores therein, for each nozzle, an ejection history of whether an ink droplet has been ejected from the nozzle or not in each of a predetermined number of continuous printing cycles up to the latest printing cycle;

a non-ejection frequency detector which detects, for each nozzle, a non-ejection frequency which corresponds to an occurrence pattern of, in the ejection history stored in the ejection history memory, the printing cycle during which an ink droplet has not been ejected from the nozzle;

a thickening degree determiner which determines, for each nozzle, a thickening degree of ink in the nozzle based on the continuous non-ejection number counted by the continuous non-ejection counter and the non-ejection frequency detected by the non-ejection frequency detector; and a potential controller which, when ejecting an ink droplet from a nozzle in a current printing cycle, controls the waveform signal output circuit in such a manner that a drive potential of the ejection waveform signal for making an ink droplet ejected from the nozzle becomes higher as a thickening degree in the nozzle determined by the thickening degree determiner increases.

6. The ink-jet recording apparatus according to claim 5, wherein the potential controller controls the waveform signal output circuit in such a manner that an initial potential of the ejection waveform signal, which is a drive potential at a time when outputting of the ejection waveform signal starts, is highest.

7. The ink-jet recording apparatus according to claim 6, wherein the potential controller includes a potential table memory which stores therein a table indicating a relation between a thickening degree and an initial potential associated with the thickening degree.

8. The ink-jet recording apparatus according to claim 5, wherein an arithmetic operation performed by the thickening degree determiner for determining the thickening degree includes a calculation of multiplying the non-ejection frequency by a first coefficient which is determined based on at least any one of a temperature of the ink-jet head, a kind of ink to be ejected from the nozzle, and a manufacture characteristic value for the ink-jet head.

9. The ink-jet recording apparatus according to claim 5, wherein an arithmetic operation performed by the thickening degree determiner for determining the thickening degree includes a calculation of multiplying the continuous non-ejection number by a second coefficient which is determined based on at least any one of a temperature of the ink-jet head, a kind of ink to be ejected from the nozzle, and a manufacture characteristic value for the ink-jet head.

10. The ink-jet recording apparatus according to claim 5, wherein the non-ejection frequency detector includes a non-ejection frequency table memory which stores therein a table indicating the relation between an occurrence pattern of the printing cycle and a non-ejection frequency associated with the occurrence pattern.

* * * * *